US012116166B2

(12) United States Patent
Hage

(10) Patent No.: US 12,116,166 B2
(45) Date of Patent: Oct. 15, 2024

(54) DEVICE FOR THE TRANSPORT OF LIQUIDS AND METHOD FOR MANUFACTURING A HANDLE FOR A DEVICE

(71) Applicant: B. Braun Avitum AG, Melsungen (DE)

(72) Inventor: Thorsten Hage, Bad Iburg (DE)

(73) Assignee: B. Braun Avitum AG, Melsungen (DE)

( * ) Notice: Subject to any disclaimer, the term of this patent is extended or adjusted under 35 U.S.C. 154(b) by 172 days.

(21) Appl. No.: 17/882,582

(22) Filed: Aug. 7, 2022

(65) Prior Publication Data

US 2023/0053325 A1 Feb. 16, 2023

(30) Foreign Application Priority Data

Aug. 12, 2021 (DE) ..... 10 2021 121 010.0

(51) Int. Cl.
*B65D 23/10* (2006.01)

(52) U.S. Cl.
CPC ..... *B65D 23/108* (2013.01); *B65D 2203/02* (2013.01)

(58) Field of Classification Search
CPC ..... B65D 23/108; B65D 2203/02; B65D 2203/00; B65D 2203/10; B65D 5/5028; B65D 5/46016; B65D 75/56
USPC ..... 206/820, 459.5; 220/759, 574; 283/81; 215/399
See application file for complete search history.

(56) References Cited

U.S. PATENT DOCUMENTS

2014/0083895 A1* 3/2014 Raming ..... B65D 25/36 428/189

FOREIGN PATENT DOCUMENTS

| | | | | |
|---|---|---|---|---|
| CH | 437122 A | | 5/1967 | |
| CH | 505588 A | | 4/1971 | |
| GB | 189807660 A | * | 3/1898 | |
| GB | 2357490 A | * | 6/2001 | ..... B65D 23/104 |

OTHER PUBLICATIONS

Search Report received in German Application No. 10 2021 121 010.0 dated Apr. 21, 2022, with translation, 7 pages.
Extended Search Report received in European Application No. 22189524.6-1014 dated Jan. 17, 2023, with translation, 7 pages.

* cited by examiner

*Primary Examiner* — Don M Anderson
*Assistant Examiner* — John Martin Hoppmann
(74) *Attorney, Agent, or Firm* — Christopher A. Rothe; CM Law PLLC

(57) ABSTRACT

A device for the transport of a liquid includes a container for holding the liquid and a handle secured to the container. The handle is formed at least in portions by a roll of a rolled flat material. A handle for a container is manufactured by a method that can include a rolling step and a securing step.

14 Claims, 4 Drawing Sheets

DEVICE FOR THE TRANSPORT OF LIQUIDS AND METHOD FOR MANUFACTURING A HANDLE FOR A DEVICE

CROSS-REFERENCE TO RELATED APPLICATION

This application claims priority to German Application No. 10 2021 121 010.0, filed Aug. 12, 2021, the content of which is incorporated by reference herein in its entirety.

FIELD

The present disclosure relates to a device for the transport of a, particularly medical, liquid comprising a container, particularly made from plastic, for holding the liquid and a handle secured to the container in accordance with the preamble of claim 1. Moreover, the present disclosure relates to a method for manufacturing a handle for a container for holding a liquid or a solid concentrate.

BACKGROUND

A generic device is disclosed, for example, in GB 2 357 490 A, according to which a container in the from of a plastic bottle is equipped with a handle. The handle is formed by a plastic strap the ends of which are bonded to an outer face of the plastic bottle.

The problem concerning the handle according to GB 2 357 490 A consists in the fact that, when the container is carried, the plastic strap easily cuts into a hand of a person carrying the container.

SUMMARY

It is therefore the object of the present invention to provide a device for the transport of a liquid which allows more comfortable handling as compared to generic containers.

A device for the transport of a, particularly medical, liquid according to the disclosure includes a container, particularly made from plastic, for holding the liquid and a handle secured to the container, particularly using an adhesive.

The handle is formed at least in portions by a roll of a rolled-up flat material. Alternatively, or additionally, the handle can be formed at least in portions by fan-shaped folding ("concertina effect").

"At least in portions" means in particular that also the entire handle may be formed by the roll. Preferably, a longitudinal extension of the roll ranges from 5 to 10 cm.

"Rolled-up" means in particular that the remaining part of the flat material is wound about a lateral edge of the flat material.

The flat material of the roll may be paper, plastic film or paper laminated with plastic film.

By forming a roll, the volume of the handle can be increased at least locally so that cutting into a hand is impeded.

According to one aspect of the disclosure, the roll can be designed so that it can be unrolled manually, in particular with no tools needed, and/or non-destructively.

When the roll is designed so that it can be manually unrolled, recycling of the materials of the handle can be advantageously facilitated.

According to one aspect of the disclosure, an instruction manual can be rolled up inside the roll. The device according to the disclosure is designed particularly for the transport of a medical liquid and the instruction manual accordingly serves particularly to illustrate an administration or use of the medical liquid.

By providing the instruction manual inside the roll, arrangement of the instruction manual on the container and arrangement of the handle on the container can take place in one step, thereby reducing expenditure in manufacturing (time, cost).

According to one aspect of the disclosure, the instruction manual can be deposited at least partially on the flat material of the roll in an area which is visible only in an unrolled state of the flat material of the roll. In other words, the instruction manual can be configured at least partially on those partial surfaces of the flat material of the roll which are rolled up in a rolled state of the flat material of the roll.

When the instruction manual is arranged on the flat material of the roll, advantageously material can be saved.

According to one aspect of the disclosure, the instruction manual can be deposited at least in part on a substrate separate from the roll and rolled-up in the roll. The substrate can be specifically paper, plastic film or paper laminated with plastic film.

By providing a separate substrate, the flexibility when using the device according to the disclosure can be increased.

According to one aspect of the disclosure, the substrate can be formed of a flat material and the flat material of the substrate can be rolled and/or folded. In particular, the flat material of the substrate may be folded such that folding edges of the flat material of the substrate extend transversely to the longitudinal direction of the handle and, resp., transversely to the longitudinal direction of the roll.

When the substrate is rolled or folded, it can be efficiently designed as a padding of the handle.

According to one aspect of the disclosure, the flat material of the substrate can be configured so that, despite an intermediate forming process, it can return to an original shape automatically or induced by a predetermined stimulus. In other words, the flat material of the substrate can be an elastic material and/or a shape-memory material. In particular, the flat material of the substrate can be a shape-memory material that is triggered via an optical stimulus, particularly such that the substrate is in a rolled state in the dark and unrolls in the light. In particular, the substrate can be formed of an elastic material such that, in the absence of external forces, the flat material of the substrate is in an unrolled or flat state or in the original shape, can be rolled only when external forces are applied and returns to the unrolled or flat state or to the original shape again when the external forces are subsequently removed.

In accordance with one aspect of the disclosure, the flat material of the roll can be configured such that, despite an intermediate forming process, it can return to an original shape automatically or induced by a predetermined stimulus. In other words, the flat material of the roll may be an elastic material and/or a shape-memory material. In particular, the roll can be formed of an elastic material such that, in the absence of external forces, the flat material of the roll is in a rolled state or in the original shape, can be unrolled only when external forces are applied and returns to the rolled state or to the original shape again when the external forces are subsequently removed.

When the substrate and/or the roll is/are made from an elastic material and/or a shape-memory material, the handling of the device according to the disclosure can be facilitated.

According to one aspect of the disclosure, a shape of the flat material of the substrate can be the original shape of the flat material of the substrate in a state in which the substrate is unrolled or unfolded, and a shape of the flat material of the roll can be the original shape of the flat material of the roll in a state in which the roll is rolled up.

By a reciprocal design, the substrate and the roll can be advantageously configured ergonomically corresponding to their respective function.

According to one aspect of the disclosure, a component for use with the container or instead of the container can be rolled up inside the roll. In particular, in the roll a tube and/or a line element can be rolled up. The tube and/or the line element can be configured such that they/it can be connected to the container to allow the liquid to flow into the container or out of the container. Particularly, the component can be simultaneously designed as a substrate according to the disclosure.

When a component is provided in the roll, the structural integrity of the handle can be improved.

According to one aspect of the disclosure, a transponder, specifically an RFID transponder, can be rolled up inside the roll, or a transponder, specifically an RFID transponder, can be part of the roll.

Providing a transponder can facilitate finding or localizing the device according to the disclosure.

According to one aspect of the disclosure, the roll can be configured as a loop that is secured to the container via an adhesive area.

When only one adhesive area is provided to secure the handle, the manufacture of the device according to the disclosure can be facilitated.

According to one aspect of the disclosure, the handle can be secured to the container such that the handle abuts on the container in a metastable state and projects from the container in a stable state.

When the handle has a metastable state in which the handle abuts on the container and a stable state in which the handle projects from the container, plural devices according to the disclosure can be stored in a space-saving manner without impeding or at least not excessively impeding the handling of a single device.

A method for manufacturing a handle for a container for holding a liquid according to the disclosure comprises the following steps of:

rolling a flat material at least in portions to form a roll and securing the roll to the container.

"At least in portions" means in particular that also the entire handle can be formed by the roll. Preferably, a longitudinal extension of the roll ranges from 5 to 10 cm.

"Rolled" means in particular that the remaining part of the flat material is wound about an edge of the flat material.

The flat material of the roll may be paper, plastic film or paper laminated with a plastic film.

The roll is secured to the container particularly by means of adhesive bonding. In particular, two opposite ends of the roll are bonded to the container so that an area between the ends acts as a handle.

According to one aspect of the disclosure, before or during rolling of the flat material to form the roll, an instruction manual can be arranged on the flat material of the roll such that the instruction manual is rolled up inside the roll after rolling.

The device, the container, the handle and/or the instruction manual regarding the method according to the disclosure can be configured in accordance with afore-described aspects of the disclosure.

BRIEF DESCRIPTION OF THE DRAWING FIGURES

The present invention will be described hereinafter in detail based on an embodiment with reference to the attached drawings, wherein.

DETAILED DESCRIPTION

Figure 1:
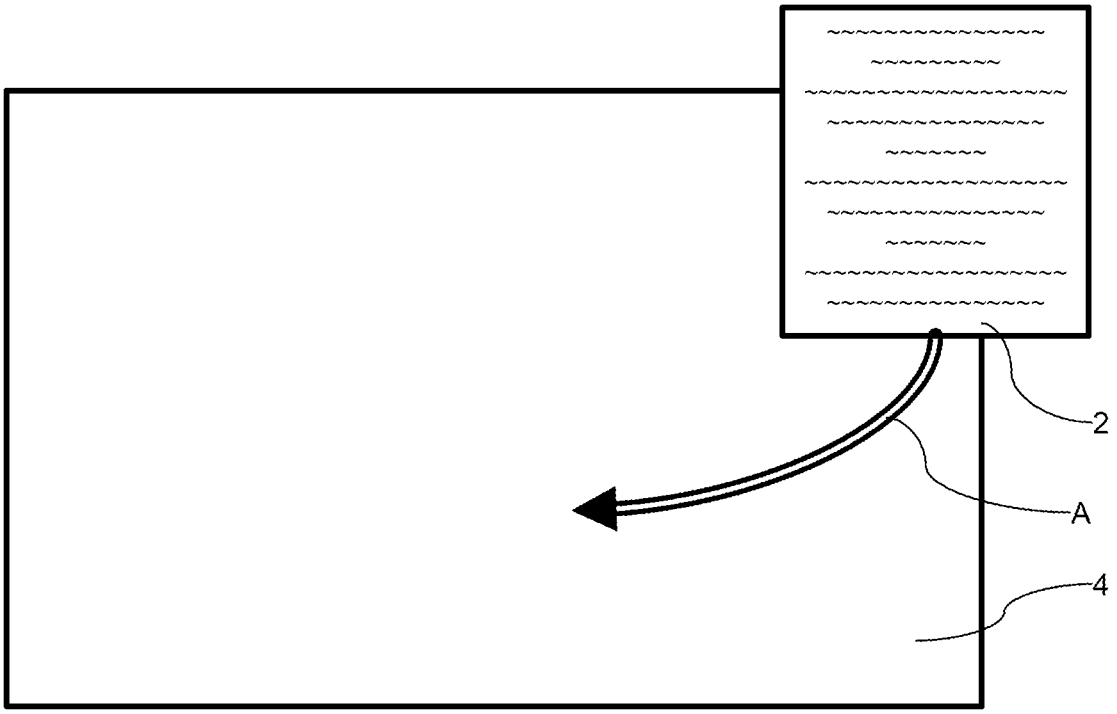
FIG. 1 shows an instruction manual according to the disclosure while being attached to a flat material.

FIG. 1 illustrates an instruction manual 2 according to the disclosure while it is attached (see arrow A) to a flat material 4. The instruction manual 2 is particularly a sheet of paper or includes plural sheets of paper. The instruction manual 2 has a substantially rectangular outline. The flat material 4 is particularly a film, preferably a plastic film, which is specifically transparent. The flat material 4 has a substantially rectangular outline and, as compared to the instruction manual 2, has longer lateral edges. The instruction manual 2 is arranged specifically by merely placing the instruction manual 2 onto the flat material 4. As an alternative, the instruction manual 2 can also be attached to the flat material 4 using an adhesive.

Figure 2:
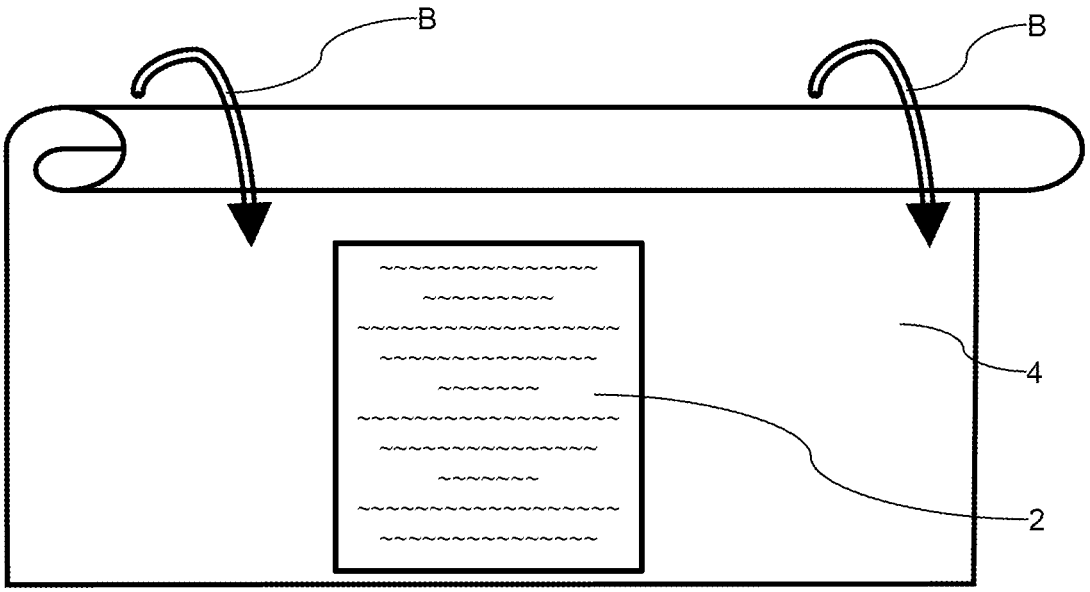
FIG. 2 shows the instruction manual according to the disclosure and the flat material while being rolled to form a roll.

FIG. 2 illustrates the instruction manual 2 attached to the flat material 4 while the flat material 4 is rolled up (see arrow B) to form a roll 6.

Figure 3:
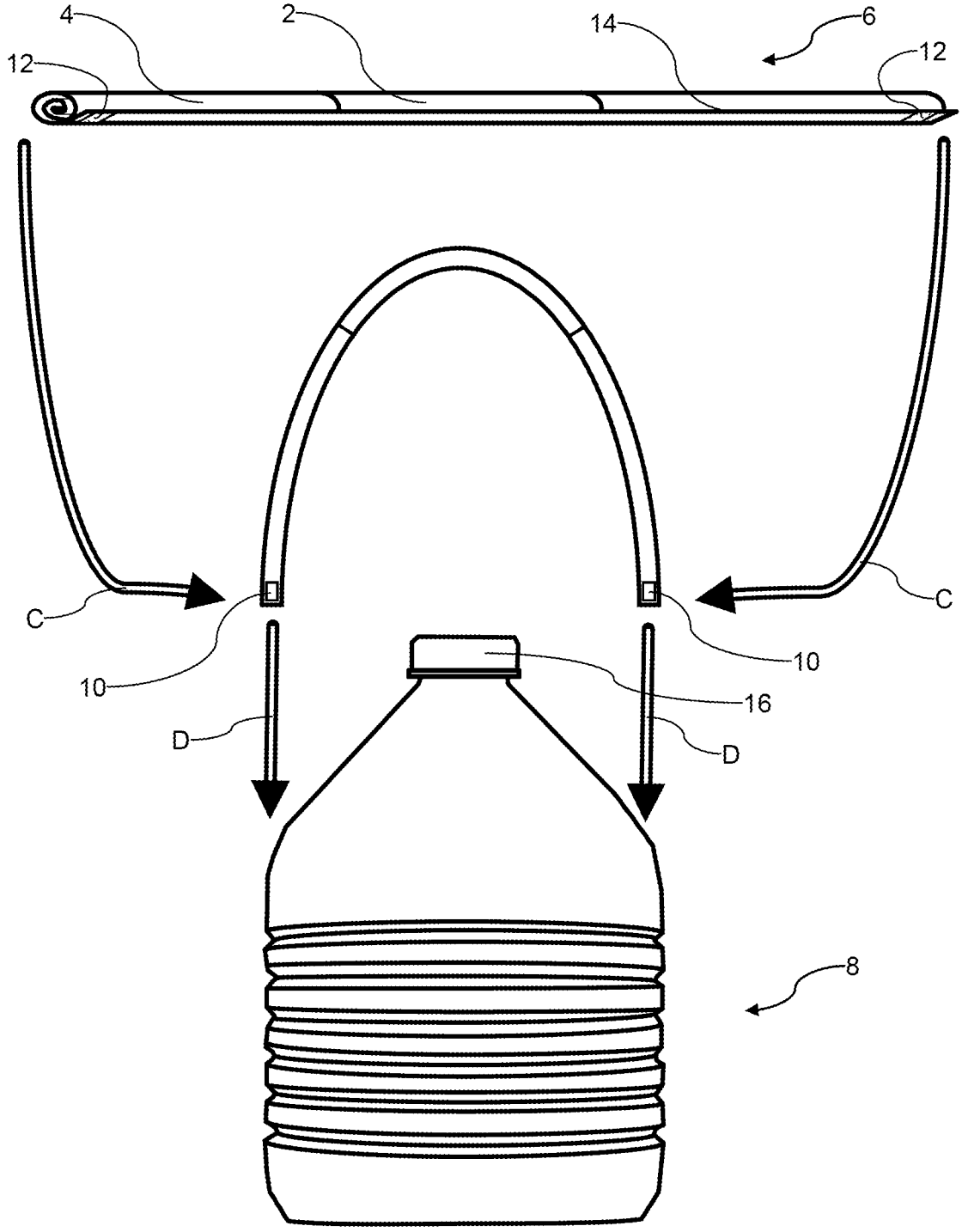
FIG. 3 shows the roll according to the disclosure while being attached to a container.

FIG. 3 illustrates the roll 6 according to the disclosure while it is attached (see arrows C and D) to a container 8.

Inadvertent unrolling of the roll 6 is particularly impeded or prevented by the roll 6 being initially bent when it is attached to the container 8 (see arrows C). After bending, unrolling of the roll 6 is possible only when the flat material 4 of the roll 6 and, where necessary, the instruction manual 2 are simultaneously formed.

The bent roll 6 is secured to the container 8 in particular using an adhesive 10, preferably using a pressure-sensitive adhesive (see arrows D). More precisely, in particular at the two ends of the roll 6 opposite in the longitudinal direction of the roll 6, the adhesive 10 is arranged and the ends of the roll 6 are subsequently pressed against an outer surface of the container 8. Preferably, the adhesive 10 is arranged at the ends of the roll 6 only in a respective area 12 of the flat material 4 that is located on an outer face of the roll 6 and that abuts on a free lateral edge 14 of the flat material 4 extending in the longitudinal direction of the roll 6. The free lateral edge 14 of the flat material 4 is a lateral edge which is not rolled up when the flat material 4 is rolled.

The container 8 is a bottle comprising a screw cap 16. The bottle is specifically a plastic bottle that is preferably transparent.

Figure 4:
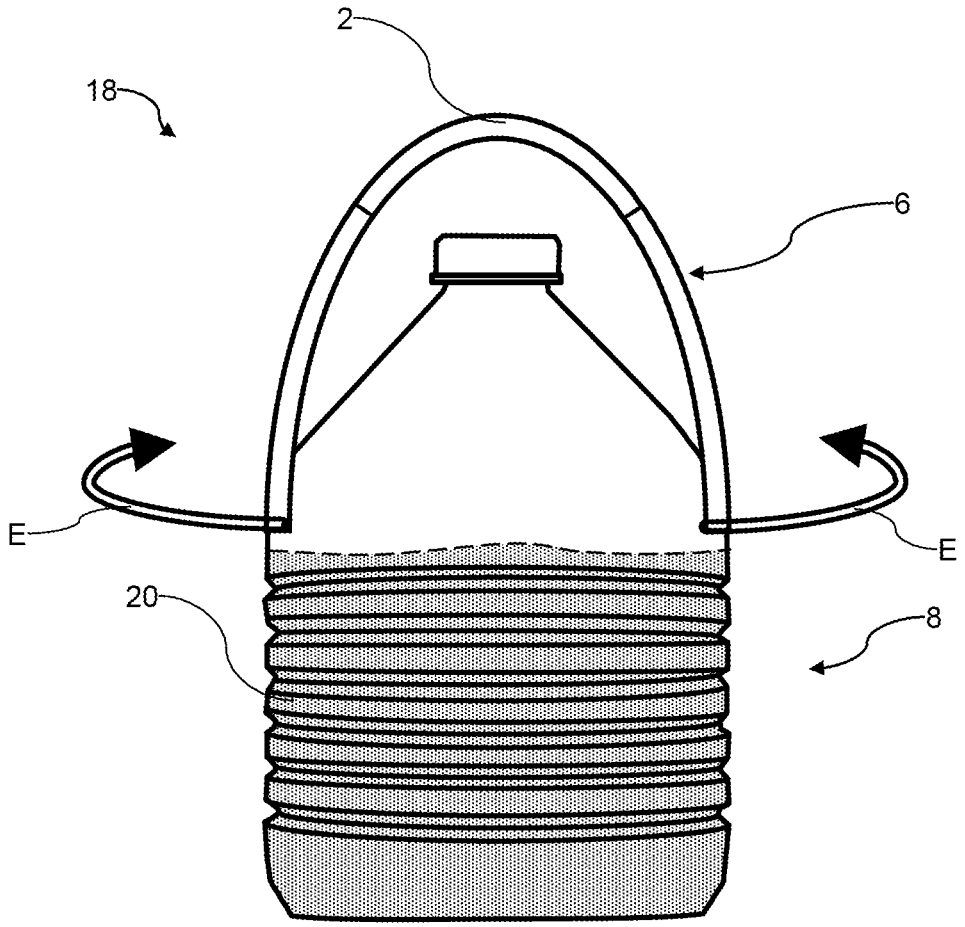
FIG. 4 shows the device according to the disclosure.

FIG. 4 illustrates a device 18 according to the disclosure with the container 8 being partially filled with a liquid 20. In order to access the instruction manual 2, the roll 6 can be unrolled (see arrows E) without being removed from the container 8 and, resp., without releasing the bonds made by the adhesive 10. Due to the bend of the roll 6, the flat material 4 of the roll 6 for this purpose has to be formed in addition to unrolling.

Figure 5:
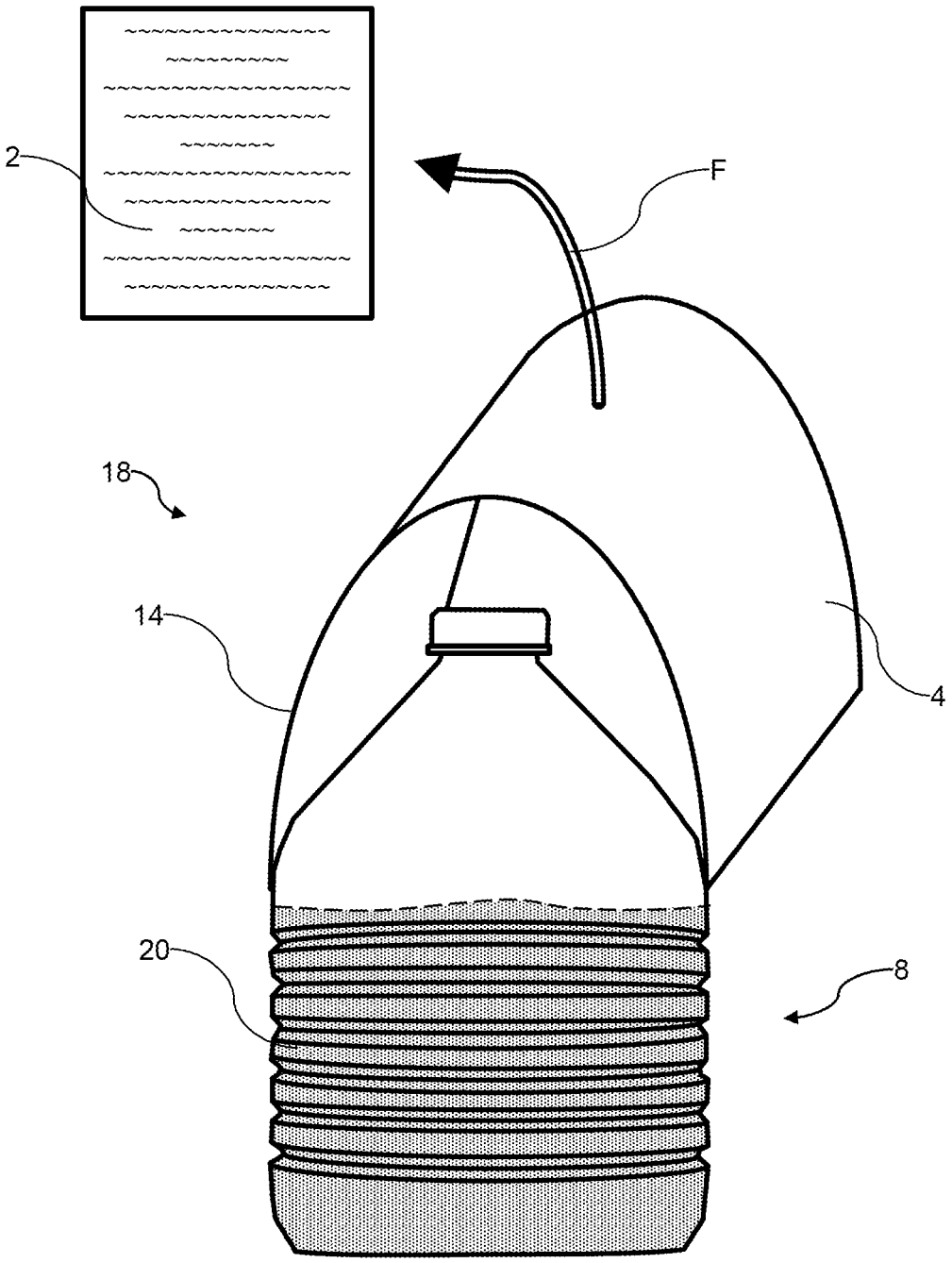
FIG. 5 shows the device according to the disclosure with the unrolled flat material of the roll.

FIG. 5 illustrates the device 18 according to the disclosure with the unrolled flat material 4 of the roll 6. As soon as the flat material 4 of the roll 6 is unrolled, the instruction manual 2 can be removed from the flat material 4 of the roll 6 (see arrow F). After that, the flat material 4 of the roll 6 can be rolled up again optionally even without the instruction manual 2 so that the instruction manual 2 can be accessed and, at the same time, the container 8 can be handled in an ergonomic manner.

The invention claimed is:

1. A device for the transport of a liquid, device comprising:

a container for holding the liquid; and a handle secured to the container, wherein the handle is formed at least in portions by a roll of a first flat material, wherein the roll is configured to be manually unrolled, and further comprising an instruction manual rolled up inside the roll.

2. The device according to claim 1, wherein the instruction manual is deposited at least in part on the first flat material in an area that is visible only when the roll is in an unrolled state.

3. The device according to claim 1, wherein the instruction manual is deposited at least in part on a substrate separate from the roll and rolled up inside the roll.

4. The device according to claim 3, wherein the substrate is formed of a second flat material that is rolled and/or folded.

5. The device according to claim 4, wherein the second flat material is configured to return to an original shape of the second flat material automatically or in response to a predetermined stimulus.

6. The device according to claim 5, wherein the first flat material is configured to return to an original shape of the first flat material automatically or in response to a predetermined stimulus.

7. The device according to claim 6, wherein:

the original shape of the first flat material is assumed when the first flat material is unrolled or unfolded, and the original shape of the second flat material is assumed when the second flat material is unrolled or unfolded.

8. The device according to claim 1, wherein a component for use with the container or instead of the container is rolled up in the roll.

9. The device according to claim 1, further comprising a transponder that is either rolled up in the roll or is part of the roll.

10. The device according to claim 1, wherein the roll is configured as a loop that is secured to the container via an adhesive area.

11. The device according to claim 1, wherein the handle is secured to the container such that the handle abuts on the container in a metastable state, and projects from the container in a stable state.

12. A method for manufacturing a handle for a container for holding a liquid, the method comprising the steps of:

rolling a flat material at least in portions to form a roll; and securing the roll to the container;

wherein an instruction manual is attached to the flat material before or during rolling of the flat material at least in portions to form the roll, such that the instruction manual is rolled up inside the roll after rolling.

13. The device according to claim 1, wherein the roll is configured to be unrolled while the handle is secured to the container.

14. The device according to claim 13, wherein the instruction manual is removable from the roll when the roll is unrolled.

* * * * *